US006698390B1

(12) United States Patent
Kostun et al.

(10) Patent No.: US 6,698,390 B1
(45) Date of Patent: Mar. 2, 2004

(54) VARIABLE TUNED TELESCOPING RESONATOR

(75) Inventors: John D. Kostun, Brighton, MI (US); David J. Moenssen, Canton, MI (US); Lakhi N. Goenka, Ann Arbor, MI (US); Christopher E. Shaw, Canton, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 10/350,585

(22) Filed: Jan. 24, 2003

(51) Int. Cl.[7] ..... F02M 35/10

(52) U.S. Cl. ..... 123/184.57; 181/229; 181/241; 181/250

(58) Field of Search ..... 123/184.55, 184.57; 181/229, 241, 250

(56) References Cited

U.S. PATENT DOCUMENTS

| | | | |
|---|---|---|---|
| 4,539,947 | A | 9/1985 | Sawada et al. |
| 5,333,576 | A | 8/1994 | Verkleeren |
| 5,628,287 | A | 5/1997 | Brackett et al. |
| 5,771,851 | A | 6/1998 | McLean |
| 5,894,823 | A | 4/1999 | Lee |
| 6,047,677 | A | 4/2000 | Kim |
| 6,192,850 | B1 | 2/2001 | Rutschmann et al. |
| 6,422,192 | B1 | 7/2002 | Bloomer |
| 2002/0108810 | A1 | 8/2002 | Kudernatsch |

FOREIGN PATENT DOCUMENTS

| | | | |
|---|---|---|---|
| JP | 03064622 | A | 3/1991 |

*Primary Examiner*—Henry C. Yuen
*Assistant Examiner*—Katrina B. Harris
(74) *Attorney, Agent, or Firm*—MacMillan, Sobanski & Todd, LLC

(57) ABSTRACT

A variable tuned telescoping resonator which militates against the emission of noise energy caused by intake air in a vehicle wherein the connector length and the volume of the resonator are varied as a function of engine speed simultaneously to provide attenuation of noise energy over a wide frequency range.

20 Claims, 7 Drawing Sheets

VARIABLE TUNED TELESCOPING RESONATOR

FIELD OF THE INVENTION

The invention relates to a resonator and more particularly to a variable tuned telescoping resonator for control of engine induction noise in a vehicle wherein the connector length and volume of the resonator are varied simultaneously.

BACKGROUND OF THE INVENTION

In an internal combustion engine for a vehicle, it is desirable to design an air induction system in which sound energy generation is minimized. Sound energy is generated as fresh air is drawn into the engine. Vibration is caused by the intake air in the air feed line which creates undesirable intake noise. Resonators of various types such as a Helmholtz type, for example, have been employed to reduce engine intake noise. Such resonators typically include a single, fixed volume chamber for dissipating the intake noise. Additionally, multiple resonators are frequently required to attenuate several noise peaks of different frequencies.

Desired noise level targets have been developed for a vehicle engine induction system. When engine order related inlet orifice noise targets are specified to be within narrow limits as a function of engine speed, the target line often cannot be met with a conventional multi-resonator system. The typical reason is that conventional resonator systems provide an attenuation profile that does not match the profile of the noise and yields unwanted accompanying side band amplification. This is particularly true for a wide band noise peak. The result is that when a peak value is reduced to the noise level target line at a given engine speed, the amplitudes of adjacent speeds are higher than the target line. Thus, the resonators are effective at attenuating noise at certain engine speeds, but ineffective at attenuating the noise at other engine speeds.

It would be desirable to produce a resonator which is variable tuned to militate against the emission of sound energy caused by the intake air at a wide range of engine speeds.

SUMMARY OF THE INVENTION

Consistent and consonant with the present invention, a variable tuned telescoping resonator which militates against the emission of sound energy caused by the intake air at a wide range of engine speeds, has surprisingly been discovered.

The variable tuned resonator system comprises:

an inner telescoping section adapted to provide fluid communication with a duct, the inner telescoping section defining a resonator connector length; and an outer telescoping section surrounding the inner telescoping section to define a chamber therebetween, the inner telescoping section and the outer telescoping section being selectively extensible and collapsible to thereby change at least one of a volume of the chamber and the resonator connector length;

wherein changing the at least one of the volume of the chamber and the resonator connector length facilitates attenuation of a desired frequency of sound entering the resonator.

BRIEF DESCRIPTION OF THE DRAWINGS

The above, as well as other objects, features, and advantages of the present invention will be understood from the detailed description of the preferred embodiments of the present invention with reference to the accompanying drawings, in which.

DETAILED DESCRIPTION OF THE PREFERRED EMBODIMENTS

Figure 1:
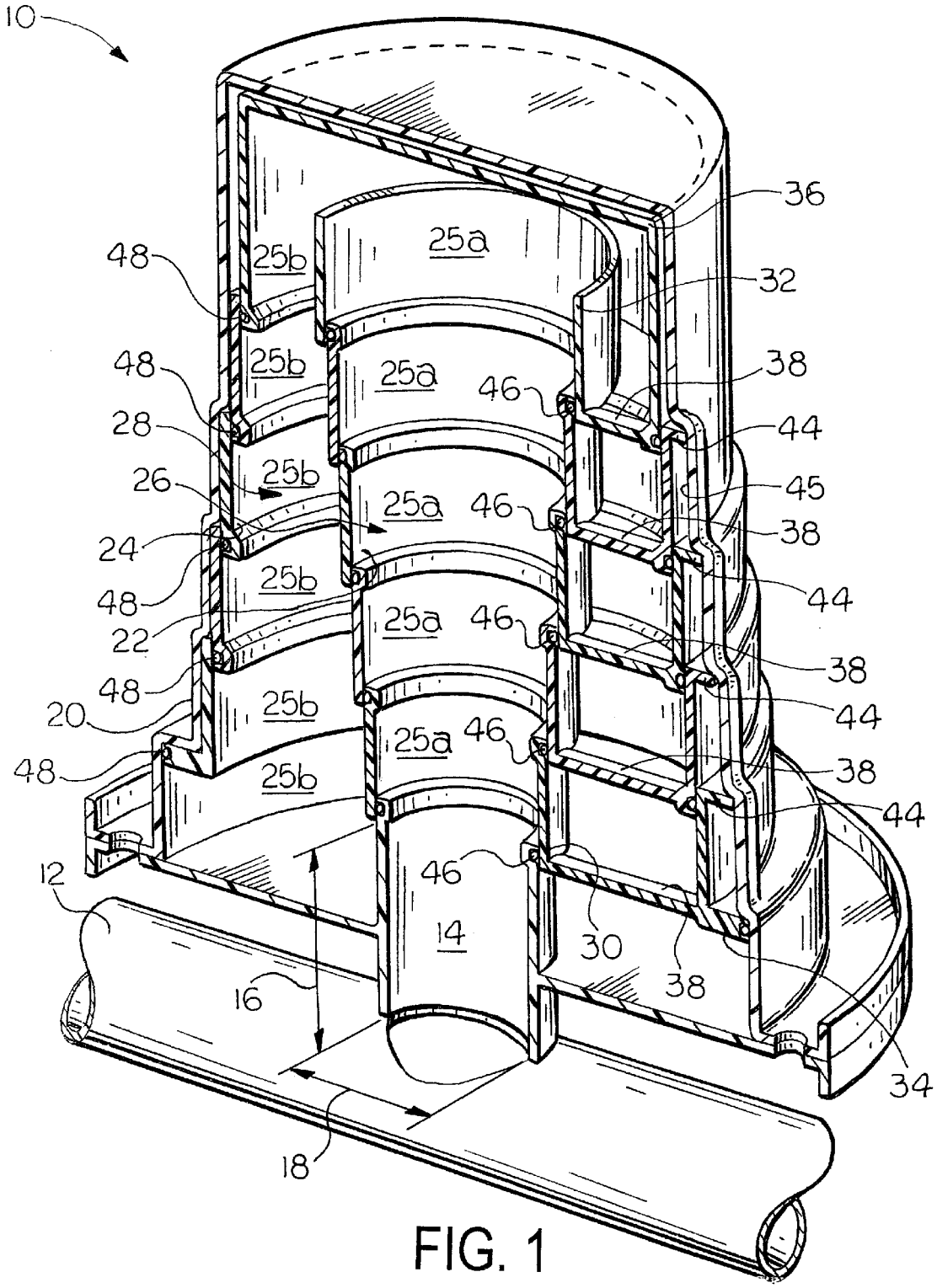
FIG. 1 is a perspective view of a variable tuned telescoping resonator shown in the extended position, with the resonator mounted on a duct and the resonator shown in section, incorporating the features of the present invention.

Referring now to the drawings, and particularly FIG. 1, there is shown generally at 10 a variable tuned telescoping resonator shown in the expanded position for use in a vehicle air intake system (not shown). The resonator 10 is mounted on and in fluid communication with a duct 12 which is in communication with the vehicle air intake system. A connector 14 attaches the resonator 10 with the duct 12. The connector 14 has a neck length 16 and a neck diameter 18.

The resonator 10 includes a hollow main housing 20. Disposed within the housing 20 are an inner telescoping section 22 and an outer telescoping section 24. In the embodiment shown, five distinct inner telescoping segments 25*a* are included in the inner telescoping section 22 and five distinct outer telescoping segments 25*b* are included in the outer telescoping section 24. It is understood that additional or fewer telescoping segments 25*a*, 25*b* could be used to arrive at a desired connector length and volume without departing from the scope and spirit of the invention. Additionally, one of the functions of the housing 20 is to provide stops to limit the movement of the telescoping segments 25*a*, 25*b*. It is understood that other internal or external stops could be used to replace the housing 20 without departing from the scope and spirit of the invention.

The inner telescoping section 22 defines an inner chamber 26 and the outer telescoping section 24 cooperates with an outer wall of the inner telescoping section 22 to define an outer;chamber 28. Together, the inner chamber 26 and the outer chamber 28 define the hollow interior of the resonator 10 volume. A first end 30 of the inner telescoping section 22 communicates with the connector 14 of the resonator 10. A second end 32 of the inner telescoping section 22 is open to the outer chamber 28. A first end 34 of the outer telescoping section 24 is spaced radially from the first end 30 of the inner telescoping section 22 and adjacent an inner wall of the housing 20. A second end 36 of the outer telescoping section 24 is spaced radially and longitudinally from the second end 32 of the inner telescoping section 22 and adjacent the inner wall of the housing 20. The second end 36 of the outer telescoping section 24 is closed to form the outer chamber 28 within the outer telescoping section 24.

Figure 2:
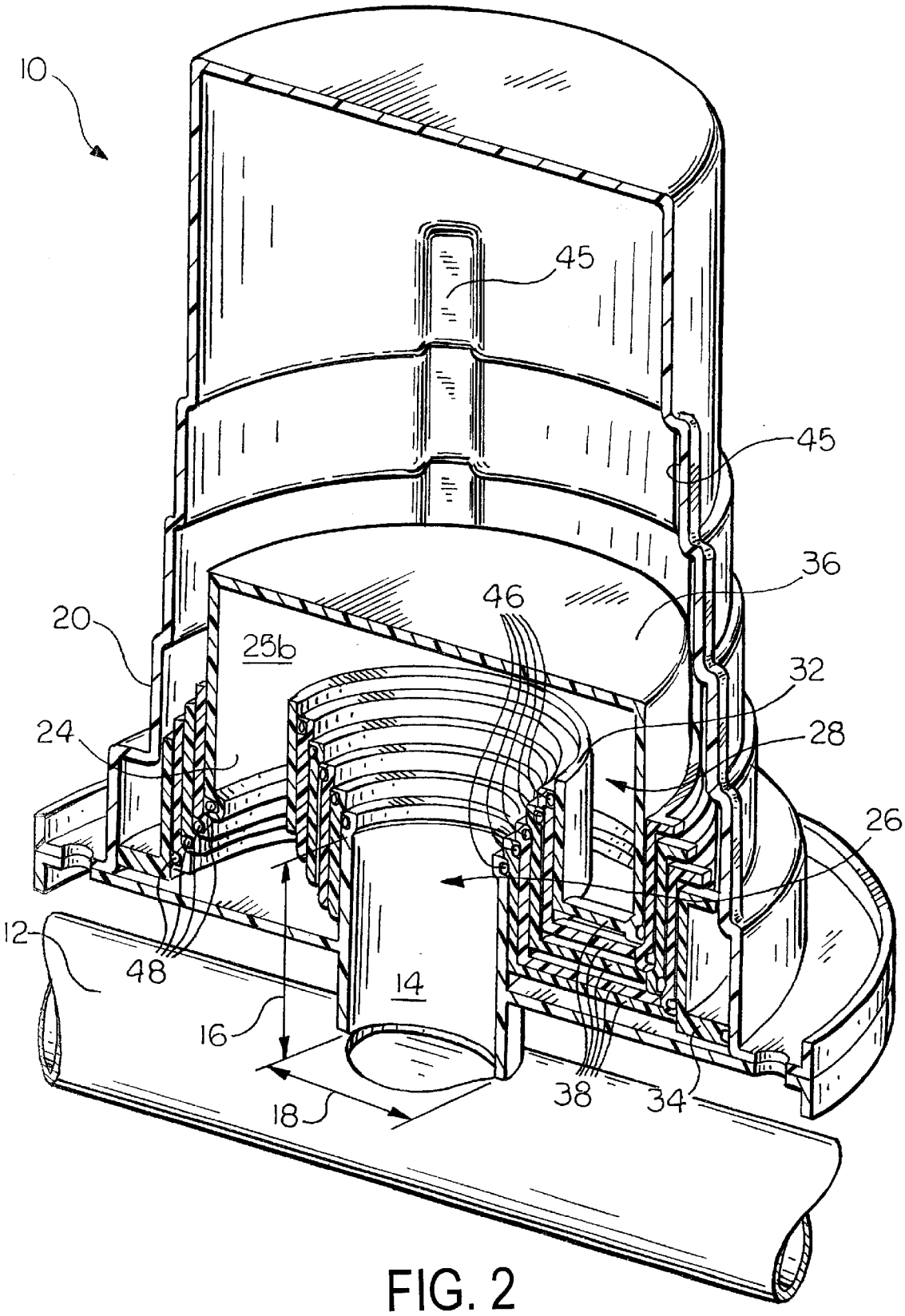
FIG. 2 is a perspective view of the variable tuned telescoping resonator illustrated in FIG. 1 shown in the collapsed position, with the resonator shown in section.
Figure 3:
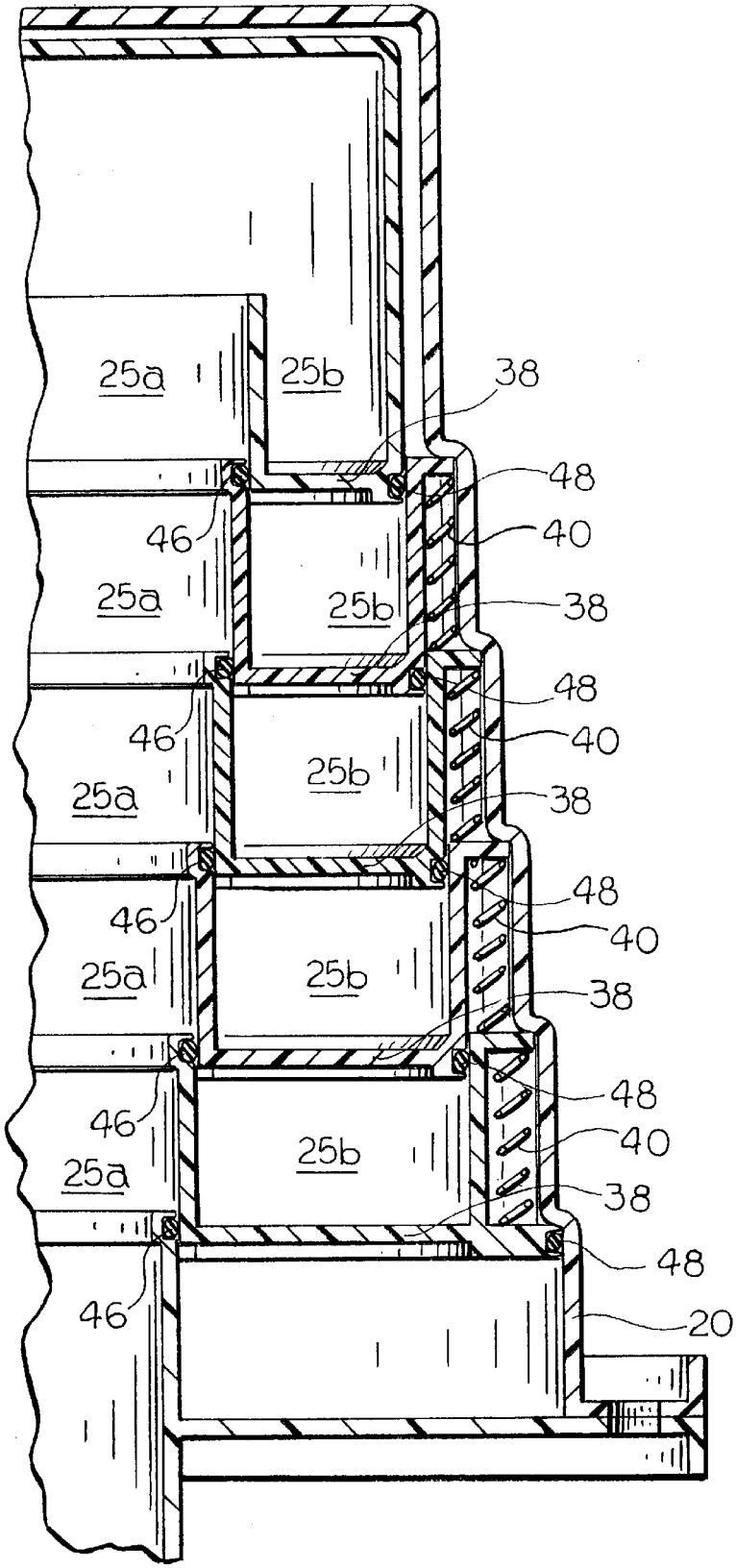
FIG. 3 is a partial sectional view of the variable tuned telescoping resonator illustrated in FIG. 1 with helical springs for sequencing of the telescoping segments.
Figure 4:
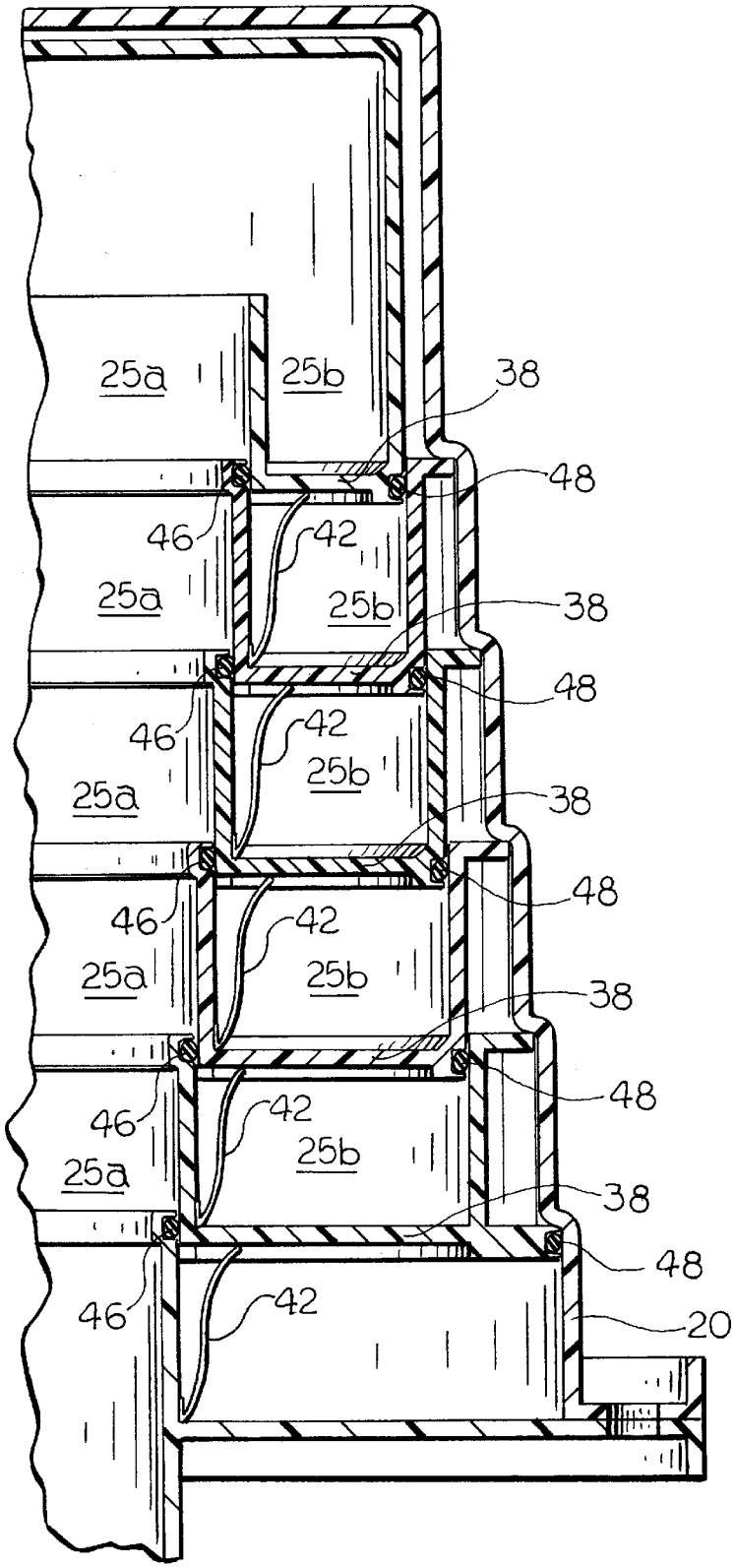
FIG. 4 is a partial sectional view of the variable tuned telescoping resonator illustrated in FIG. 1 showing an alternate embodiment for sequencing the telescoping segments using leaf type springs.

A plurality of radial struts 38 are disposed between and connect each adjacent inner telescoping segment 25*a* and outer telescoping segment 25*b*. A plurality of helical springs 40 is disposed between each adjacent outer telescoping segment 25*b*, as illustrated in FIG. 3. Alternatively, a plurality of leaf type springs 42 is disposed to abut the inner telescoping segments 25*a* and the radial strut 38 of the adjacent inner telescoping segment 25a, as illustrated in FIG. 4. It is understood that other spring types, configurations, and locations could be used without departing from the scope and spirit of the invention. A stop tab 44 extends radially outwardly from an outer surface of each of the outer telescoping segments 25*b*. Three tabs 44 are spaced circumferentially at 120 degrees apart in the embodiment shown. The tab 44 is disposed in a slot 45 as clearly shown in FIGS. 1 and 2. Inner o-rings 46 are disposed between adjacent inner telescoping segments 25*a* and outer o-rings 48 are disposed between adjacent outer telescoping segments 25*b*. FIG. 2 shows the telescoping sections 22, 24 in the collapsed position, which can be attained using a motive driver connected to a linkage, an example of which is shown schematically in FIG. 5. It is also understood that the linkage can be received in and guided by an aperture in a wall of the housing 20, for example.

Figure 5:
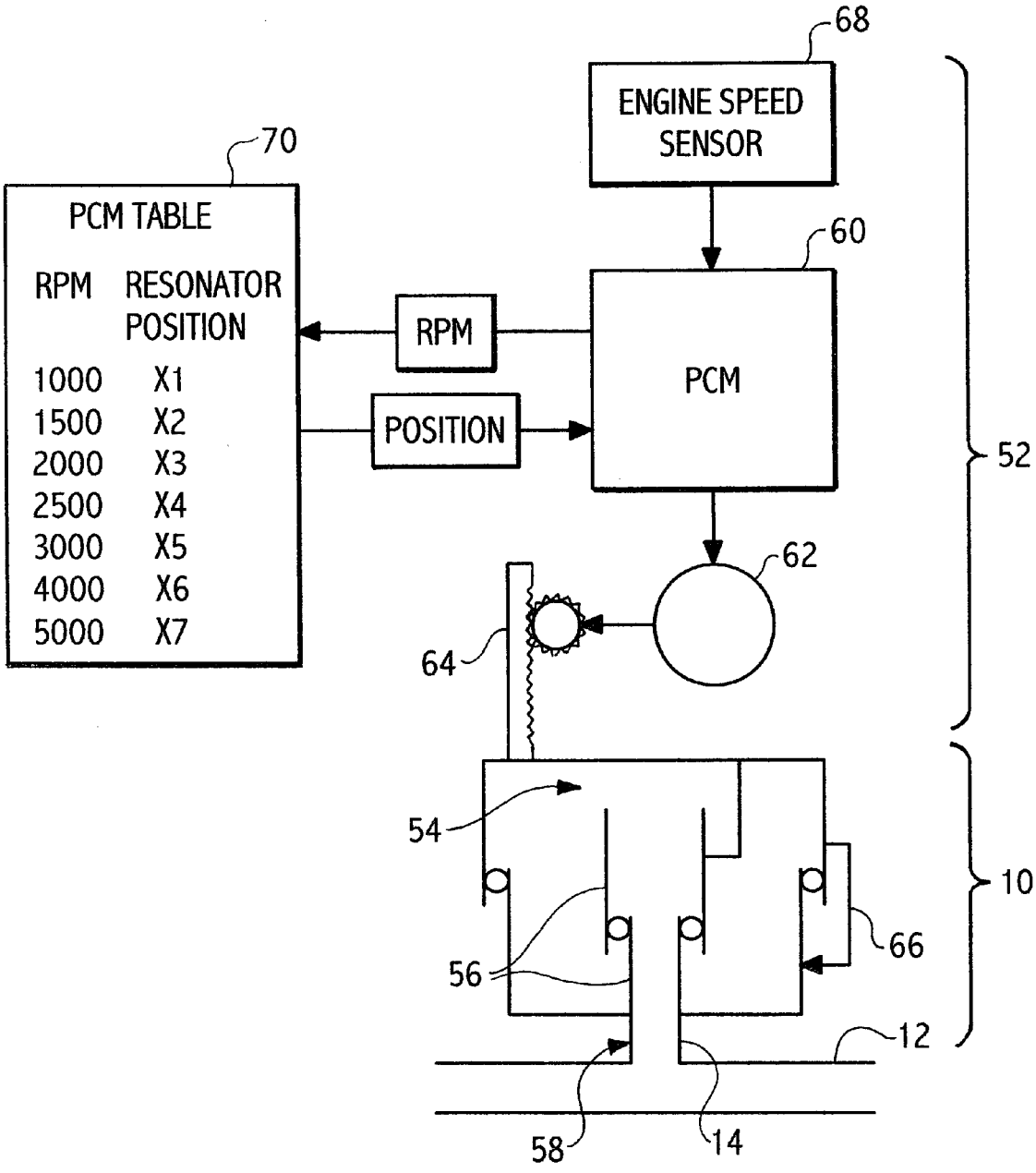
FIG. 5 is a schematic diagram of the variable tuned telescoping resonator illustrated in FIG. 1 with a control system for controlling the volume and connector length of the resonator at different engine speeds.

Referring now to FIG. 5, there is shown a schematic diagram of the resonator 10 including a control system 52 for controlling the extending and collapsing of the telescoping sections 22, 24. By controlling the telescoping sections 22, 24, the resonator volume 54 (volume of the outer chamber 28) and resonator connector length 56 (the neck length 16 of the connector 14 plus the length of the inner telescoping section 22) are controlled at different vehicle engine speeds. A programmable control module or PCM 60 is electrically connected to a motor 62. The motor 62 is drivingly engaged with a rack and pinion type actuator 64. It is understood that other actuator types may be used without departing from the scope and spirit of the invention. The rack portion of the rack and pinion actuator 64 is connected to the resonator 10 such that the resonator volume 54 and the resonator connector length 56 can be selectively varied as desired. A position sensor and transmitter 66 provides positional feedback to the PCM 60 from the resonator 10. An engine speed sensor and transmitter 68 senses and transmits engine speed to the PCM 60. The PCM 60 accesses a PCM table 70 to find a required position for the resonator 10 based upon engine speed. The required position of the resonator 10 is then compared with the positional feedback from the position sensor and transmitter 66. If the positional feedback differs from the required position, a position adjustment is made by the PCM 60 by operating the motor 62 to adjust the rack and pinion actuator 64 as needed. It is understood that other structures could be used to vary the resonator volume 54 and the resonator connector length 56 such as a stepper motor, for example.

In operation, air travels through the duct 12. Sound generated by the vehicle engine travels through the duct 12 and enters the resonator 10 through the connector 14. A sound frequency generated by the engine differs at different engine speeds. Therefore, in order to meet target sound pressure levels, the resonator 10 is required to attenuate a wide range of frequencies. This is accomplished by varying the resonator connector length 56 and the resonator volume 54. The inner telescoping section 22 acts as an adjustable extension to the connector 14 and thereby permits adjustment of the resonator connector length 56. Adjustment of the length of the outer telescoping section 24 permits adjustment of the resonator volume 54. Simultaneous adjustment of the inner telescoping section 22 and the outer telescoping section 24 facilitates fine tuning of the resonator 10 over a wide range of frequencies. Thus, the desired attenuation of sound emitted from the vehicle engine over a wide range of frequencies is accomplished. It is understood that the inner telescoping section 22 and the outer telescoping section 24 can be independently adjusted without departing from the scope and spirit of the invention.

The method of controlling the resonator 10 by the PCM 60 is accomplished by first mapping the characteristics of the resonator 10 at various telescoping positions at each engine speed. The resonator position versus engine speed is organized into the PCM table 70. The resonator positions are determined by comparing the difference between base and target characteristics at each engine speed to a map of resonator performance. The resonator position which best meets the target at each engine speed is organized into the PCM table 70. It should be noted that to achieve the best efficiency, the resonator 10 should be placed in the air induction system of the vehicle where it will most efficiently attenuate the frequencies of interest. For example, the chosen location should not be near a pressure nodal point of the frequencies of interest, but at a location where the standing wave pressures for the frequencies of interest are values which would provide reasonable attenuation.

The resonator 10 can be precisely controlled by controlling the repeatability of the telescoping motion of the inner telescoping section 22 and the outer telescoping section 24. To be repeatable, the telescoping motion of the inner telescoping section 22 and the outer telescoping section 24 in each section must occur in the same sequence when extending or contracting. The position of each of the telescoping segments 25*a*, 25*b* must be the same when in the extending or the contracting mode. The repeatability is accomplished using two distinct methods. First, the axial position of the telescoping segments 25*a*, 25*b* is maintained by the radial struts 38. Second, in the embodiments using the springs 40 and the springs 42, the spring constant of the springs 40 and the springs 42 are designed so that the compression force required to move each of the telescoping segments 25*a*, 25*b* adjacent the first ends 30, 34 of the telescoping sections 22, 24, respectively, is an order of magnitude higher than the frictional forces generated by the o-rings 46, 48 of the telescoping segments 25*a*, 25*b* adjacent the second ends 32, 36 of the telescoping sections 22, 24, respectively. Additionally, the tab 44 militates against the telescoping segments 25*a*, 25*b* from extending beyond a desired telescoping position.

Figure 6:
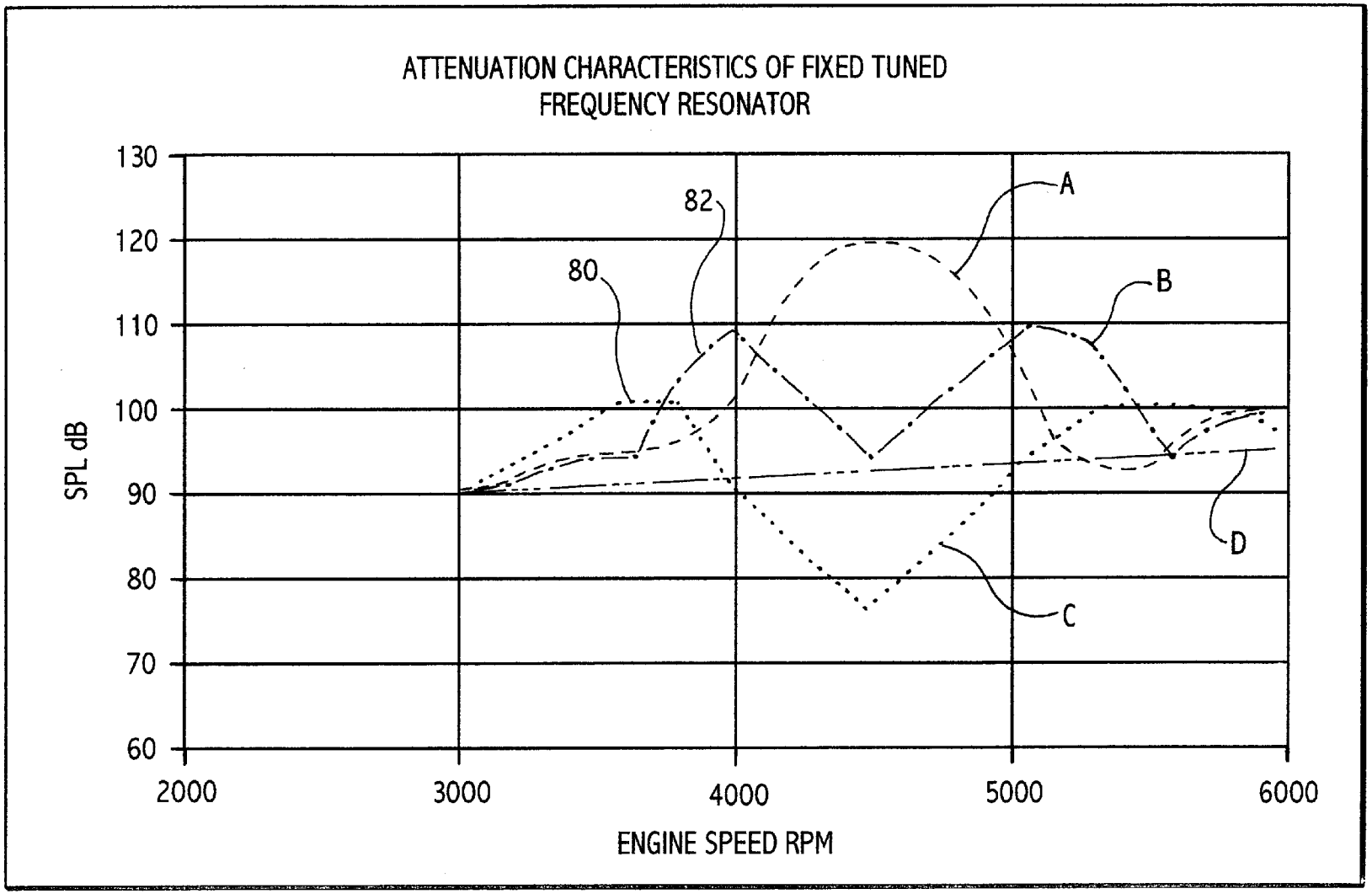
FIG. 6 is a graph showing a plot of the sound pressure level (SPL) in decibels vs. engine speed in RPM for noise emission without a resonator, noise emission with a one liter volume resonator, noise emission with a two liter volume resonator, and a target level for noise emission.

FIG. 6 illustrates the attenuation characteristics of fixed volume resonators. Curve A shows the sound pressure level or SPL in decibels without a resonator. Curve B shows the SPL with a 1.0 liter volume resonator. Curve C shows the SPL with a 2.0 liter volume resonator. Line D shows a target SPL. Fixed volume resonators provide a notch type attenuation with side band amplification that does not match the attenuation required to reduce a noise peak to a specific target line. As illustrated by curve B in FIG. 6, a low volume 1.0 liter resonator attenuates the SPL at 4500 rpm to near the target line D, but the remainder of curve B remains above the target line D. As the resonator gets larger, providing more attenuation, the attenuation bandwidth and notch depth increases. For the 2.0 liter resonator, the curve C is equal or below the target line D from 4000 to 5000 rpm. However, the side band amplification 80 of the 2.0 liter resonator is increased compared to the side band amplification 82 of the 1.0 liter resonator. As FIG. 6 illustrates, notch type attenuation does not provide the degree of control required to meet a specific target line.

The resonator 10 minimizes the problems associated with the fixed volume or notch type attenuation resonator, since at each engine speed the resonator 10 can be set to a desired telescoping position to provide the required attenuation. Additionally, where part of the noise curve lies below the target line D, amplification can be provided in the side band amplification region of the SPL curve to reach the target line D as desired.

Figure 7:
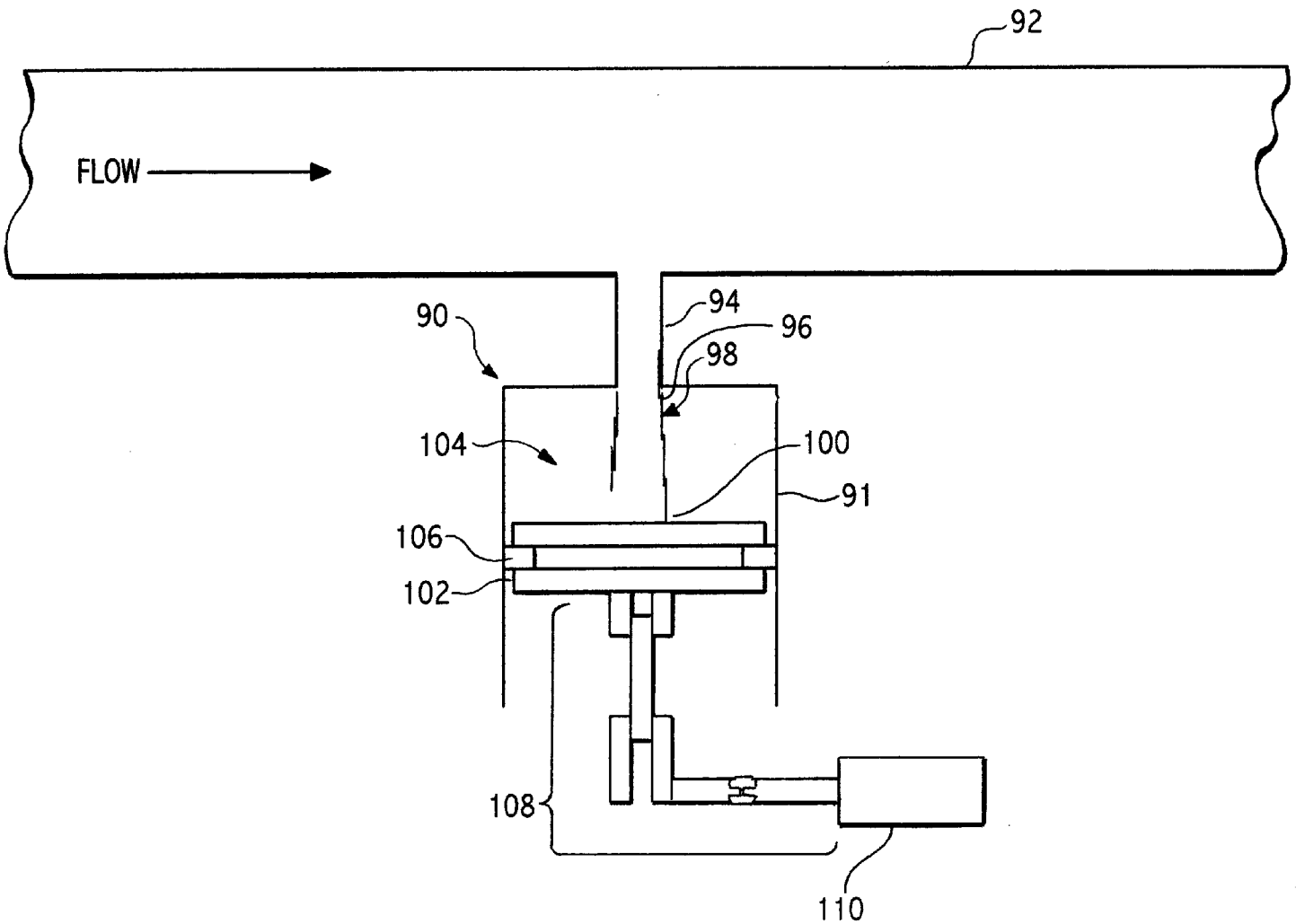
FIG. 7 is a schematic diagram of an alternate embodiment of the invention showing a resonator including an inner telescoping member operably coupled with a piston.

An alternate embodiment of the invention is illustrated in FIG. 7. A resonator 90 includes a main housing 91 is connected to a duct 92 by a connector 94. A first end 96 of an inner telescoping section 98 communicates with the connector 94. A second end 100 of the inner telescoping section 98 is coupled to a piston 102 which cooperates with the inner walls of the housing 91 to form a resonator chamber 104. The inner telescoping section 98 cooperates with the connector 94 to define a resonator connector length. A seal 106 is disposed between an outer wall of the piston 102 and the inner wall of the housing 91. An actuator assembly 108 operatively connects the piston 102 with a motor 110.

In operation, the position of the piston 102 is varied to vary a volume of the resonator chamber 104. As the piston 102 is caused to move towards the connector 94, the volume of the resonator chamber 104 is decreased. As the piston 102 is caused to move away from the connector 94, the volume of the resonator chamber 104 is caused to increase. The inner telescoping section 96 is likewise caused to move with the piston 102. As the piston 102 is caused to move towards the connector 94, the inner telescoping section 98 is caused to collapse, thereby decreasing the resonator connector length. As the piston 102 is caused to move away from the connector 94, the inner telescoping section 98 is caused to extend, thereby increasing the resonator connector length. Thus, by controlling the piston 102 and the inner telescoping section 98 to vary the volume of the resonator chamber 104 and the resonator connector length as described for the other embodiments of the invention, the resonator 90 is effective to control a wide range of sound frequencies. It should be noted that the piston 102 can be used with a resonator having a fixed resonator connector length without departing from the scope and spirit of the invention.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A variable tuned resonator comprising:

an inner telescoping section adapted to provide fluid communication with a duct, said inner telescoping section defining a resonator connector length; and an outer telescoping section surrounding said inner telescoping section to define a chamber therebetween, said inner telescoping section and said outer telescoping section being selectively extensible and collapsible to thereby change at least one of a volume of the chamber and the resonator connector length;

wherein changing the at least one of the volume of the chamber and the resonator connector length facilitates attenuation of a desired frequency of sound entering the resonator.

2. The resonator according to claim 1, wherein both the volume of the chamber and the resonator connector length are changed simultaneously.

3. The resonator according to claim 1, wherein said inner telescoping section and said outer telescoping section are concentric.

4. The resonator according to claim 1, wherein said inner telescoping section and said outer telescoping section are joined by a plurality of radial struts to cause said inner telescoping section and said outer telescoping section to extend and collapse simultaneously.

5. The resonator according to claim 1, wherein said inner telescoping section includes a plurality of inner telescoping segments.

6. The resonator according to claim 5, wherein a spring is disposed between each of the inner telescoping segments, the spring urging said inner telescoping section towards an extended position.

7. The resonator according to claim 1, wherein said outer telescoping section includes a plurality of outer telescoping segments.

8. The resonator according to claim 7, wherein a spring is disposed between each of the outer telescoping segments, the spring urging said outer telescoping section towards an extended position.

9. A variable tuned resonator comprising:

an inner telescoping section adapted to provide fluid communication with a duct, said inner telescoping section defining a resonator connector length;

an outer telescoping section surrounding said inner telescoping section to define a chamber therebetween, said inner telescoping section and said outer telescoping section being selectively extensible and collapsible to thereby change at least one of a volume of the chamber and the resonator connector length, wherein changing the at least one of the volume of the chamber and the resonator connector length facilitates attenuation of a desired frequency of sound travelling through said duct; and a resonator control system comprising:

a programmable control module; and an actuator adapted to be controlled by said programmable control module, said actuator operatively engaged with said inner telescoping section and said outer telescoping section to extend and collapse said inner telescoping section and said outer telescoping section to thereby control the volume of the chamber and the resonator connector length;

wherein said programmable control module controls said actuator responsive to engine speed of an automobile engine.

10. The resonator according to claim 9, including an engine speed sensor and transmitter to sense and transmit engine speed to said programmable control module.

11. The resonator according to claim 9, wherein said actuator is a rack and pinion type actuator.

12. The resonator according to claim 9, wherein both the volume of the chamber and the resonator connector length are changed simultaneously.

13. The resonator according to claim 9, wherein said inner telescoping section and said outer telescoping section are joined by a plurality of radial struts to cause said inner telescoping section and said outer telescoping section to extend and collapse simultaneously.

14. The resonator according to claim 9, wherein said inner telescoping section includes a plurality of inner telescoping segments.

15. The resonator according to claim 14, wherein a spring is disposed between each of the inner telescoping segments, the spring urging said inner telescoping section towards an extended position.

16. The resonator according to claim 9, wherein said outer telescoping section includes a plurality of outer telescoping segments.

17. The resonator according to claim 16, wherein a spring is disposed between each of the outer telescoping segments, the spring urging said outer telescoping section towards an extended position.

18. A variable tuned resonator comprising:

a hollow housing having a connector adapted to provide fluid communication with a duct;

an inner telescoping section disposed within said housing and having a first end and a second end, the first end of said inner telescoping section in fluid communication with the connector of said housing, said inner telescoping section and the connector cooperating to define a resonator connector length; and a piston selectively reciprocable within said housing and cooperating with said housing to form a resonator chamber, said piston coupled to the second end of said inner telescoping section and causing said inner telescoping section to extend and collapse during reciprocation of said piston, reciprocation of said piston changing a volume of the resonator chamber, and extending and collapsing of said inner telescoping section changing the resonator connector length;

wherein changing the volume of the resonator chamber and the resonator connector length facilitates attenuation of a desired frequency of sound entering the resonator.

19. A variable tuned resonator comprising:

a hollow housing having a connector adapted to provide fluid communication with a duct;

an inner telescoping section in fluid communication with the connector of said housing and disposed within said housing, said inner telescoping section and the connector cooperating to define a resonator connector length; and an outer telescoping section disposed within said housing and surrounding said inner telescoping section to define a chamber therebetween, said inner telescoping section and said outer telescoping section being selectively extensible and collapsible to thereby change at least one of a volume of the chamber and the resonator connector length;

wherein changing the at least one of the volume of the chamber and the resonator connector length facilitates attenuation of a desired frequency of sound entering the resonator.

20. A method of controlling a variable tuned telescoping resonator, the method comprising the steps of:

sensing an engine speed and transmitting said sensed engine speed to a programmable control module;

matching said sensed engine speed with a stored resonator position value stored in a table in the programmable control module, wherein the table is created by determining a desired attenuation value for each engine speed to reach a desired sound pressure level, calculating an attenuation characteristic at each resonator position to determine the stored resonator position value at each resonator position, and matching the desired attenuation value at an engine speed with the attenuation characteristic of the resonator at each resonator position, thereby establishing the stored resonator position value for the engine speed; and adjusting at least one of a resonator connector length and a resonator volume according to the stored resonator position value.

* * * * *